US006924767B2

(12) United States Patent
Kitahara et al.

(10) Patent No.: US 6,924,767 B2
(45) Date of Patent: Aug. 2, 2005

(54) RECEPTION ANTENNA, CORE, AND PORTABLE DEVICE

(75) Inventors: Takahide Kitahara, Kariya (JP); Nobuyoshi Nagai, Kariya (JP)

(73) Assignee: Denso Corporation, Kariya (JP)

( * ) Notice: Subject to any disclaimer, the term of this patent is extended or adjusted under 35 U.S.C. 154(b) by 89 days.

(21) Appl. No.: 10/430,287

(22) Filed: May 7, 2003

(65) Prior Publication Data

US 2003/0222829 A1 Dec. 4, 2003

(30) Foreign Application Priority Data

Jun. 4, 2002 (JP) ..... 2002-162705

(51) Int. Cl.[7] ..... H01Q 1/24; H01Q 7/06
(52) U.S. Cl. ..... 343/702; 343/788; 343/867
(58) Field of Search ..... 343/702, 742, 343/787, 788, 867

(56) References Cited

U.S. PATENT DOCUMENTS 5,047,715 A * 9/1991 Morgenstern ..... 324/207.17
5,281,941 A 1/1994 Bernstein ..... 343/867
6,407,677 B1 * 6/2002 Avenel et al. ..... 340/941
6,563,474 B2 * 5/2003 Nantz et al. ..... 343/788

FOREIGN PATENT DOCUMENTS

| | | |
|---|---|---|
| EP | 1 376 762 A1 | 6/2003 |
| GB | 2326 769 | 12/1998 |
| JP | A-08-293725 | 11/1996 |
| JP | A-2003-92509 | 3/2003 |

OTHER PUBLICATIONS

Search Report dated Feb. 27, 2004.

* cited by examiner

*Primary Examiner*—Michael C. Wimer
(74) *Attorney, Agent, or Firm*—Posz Law Group, PLC

(57) ABSTRACT

A reception antenna is formed of a column-profiled ferrite core and three antenna coils, each of which is formed by winding electric wire around the core. Each central axis of the three antenna coils is mutually disposed orthogonally at a barycenter of the core. Each of the three antenna coils is symmetrical with respect to the barycenter. A third antenna coil and each of a first antenna coil and a second antenna coil are overlapped with a space. The first antenna coil and the second antenna coil are overlapped with direct contact, where a starting end of the second antenna and a terminating end (outward end) of the first antenna is connected.

6 Claims, 12 Drawing Sheets

X, Y-AXIS ANTENNA CHARACTERISTIC

CORE DIAMETER φ=12

CORE THICKNESS t=2

Z-AXIS ANTENNA CHARACTERISTIC

CORE DIAMETER φ=12

CORE THICKNESS t=2

RECEPTION ANTENNA, CORE, AND PORTABLE DEVICE

CROSS REFERENCE TO RELATED APPLICATIONS

This application is based on and incorporates herein by reference Japanese Patent Application No. 2002-162705 filed on Jun. 4, 2002.

FIELD OF THE INVENTION

The present invention relates to a reception antenna whose three antenna coils are mutually orthogonal, a core included in the reception antenna, and a portable device using the reception antenna.

BACKGROUND OF THE INVENTION

Conventionally, it is known that an electronic key system controls locking/unlocking of a vehicle door through communicating by wireless between an in-vehicle device mounted in a vehicle and an electronic key unique to the vehicle.

In this electronic key system, the in-vehicle device periodically sends out a signal to the outside of the vehicle, for instance, when a key is not inserted into a key cylinder of the vehicle and furthermore all doors of the vehicle are locked. When a driver having an electronic key is near the vehicle, a response signal to the signal sent from the in-vehicle device is returned from the electronic key. As the in-vehicle device receives the response signal, it executes authentication with the electronic key. When the in-vehicle device successfully completes the authentication and thereafter detects that a hand is put into a doorknob, it automatically releases locking of the doors.

Incidentally, an antenna of the in-vehicle device or the electronic key is typically formed of an antenna coil and an external capacitor. The antenna coil is formed by winding electric wire around a stick ferrite core. The external capacitor constitutes a parallel resonance circuit with the antenna coil. However, when the reception antenna of the electronic key is formed of a single antenna coil, a communication distance (where data from the vehicle can be received) extremely decreases depending on relationship with a direction of a magnetic field generated by a transmission antenna of the in-vehicle device. At worst, the communication becomes impossible.

In detail, the reception antenna of the electronic key is most sensitive when an axial direction of the antenna coil of the reception antenna is parallel with the direction of the magnetic field generated by the transmission antenna of the in-vehicle device. That is, an electric voltage is most efficiently induced in the antenna coil of the electronic key. By contrast, the reception antenna of the electronic key is least sensitive when the axial direction is orthogonal to the direction of the magnetic field. That is, the electric voltage is hardly induced in the antenna coil of the electronic key.

The reception antenna of the electronic key needs to stably receive the signal from the in-vehicle device irrespective of the relationship with the direction of the transmission antenna of the in-vehicle device. The reception antenna needs to be formed into being nondirectional using a plurality of antenna coils.

Constructing of the reception antenna with the plurality of the antenna coils involves a large volume for disposing the reception antenna. Closely disposing the plurality of the antenna coils in the limited volume inside the electronic key may result in lowering communication performance due to mutual interference among the antenna coils.

SUMMARY OF THE INVENTION

It is an object to provide a reception antenna that has a nondirectional characteristic even within a small volume, a core included in the reception antenna, and a portable device using the reception antenna.

To achieve the above object, a reception antenna is provided with the following. Three antenna coils are disposed and their center axes intersect mutually orthogonally at an intersecting point. Each of them is symmetrical to the intersecting point. A core around which electric wire is wound is disposed for forming each of the three antenna coils. A first antenna coil of the three antenna coils is inwardly formed and a third antenna coil is outwardly formed. A second antenna coil is formed between the first and third antenna coils. The second antenna coil and one of the first and the third antenna coils constitutes a pair of selected antenna coils. A terminating end of winding electric wire of an inwardly-located antenna coil of the pair is connected with a starting end of winding electric wire of an outwardly-located antenna coil of the pair. This structure enables the reception antenna to be downsized and prevents interference among the antenna coils due to stray capacitance generated from an overlapping area between the antenna coils.

It is preferable that the other antenna coil that is excluded from the pair of the selected antenna coils and each of the pair of the selected antenna coils are overlapped with a space. Providing the space results in additionally enhancing prevention of the influence of the stray capacitance in the reception antenna.

Furthermore, a core for forming each of three antenna coils has a shape of a cylinder or a prism whose sectional plane is symmetrical to a point where a center axis of the core passes through. A first groove member is formed on a surface of the core and orbits along a perimeter of a first virtual sectional plane, which includes the center axis of the core. A second groove member is formed on the surface of the core and orbits along a perimeter of a second virtual sectional plane, which includes the center axis of the core, wherein the second virtual sectional plane is orthogonal to the first virtual sectional plane. A third groove member is formed on the surface of the core and orbits along a perimeter of a third virtual sectional plane that is orthogonal to the central axis. The perimeter of the third virtual sectional plane is on a curved surface that is disposed between base surfaces of the core, the base surfaces which are symmetrical to the point where the center axis passes through. This structure of the core enables the reception antenna to be efficiently realized.

Furthermore, a portable device that includes the reception antenna is provided with the following. A reception circuit receives, through the three antenna coils, a signal to demodulate into a digital signal. A control circuit executes a control based on the digital signal demodulated in the reception circuit. This structure enables the portable device to be compactly constructed and suitable for a portable device such as an electronic key.

BRIEF DESCRIPTION OF THE DRAWINGS

The above and other objects, features and advantages of the present invention will, become more apparent from the following detailed description made with reference to the accompanying drawings. In the drawings.

DETAILED DESCRIPTION OF THE PREFERRED EMBODIMENTS

Figure 1B:
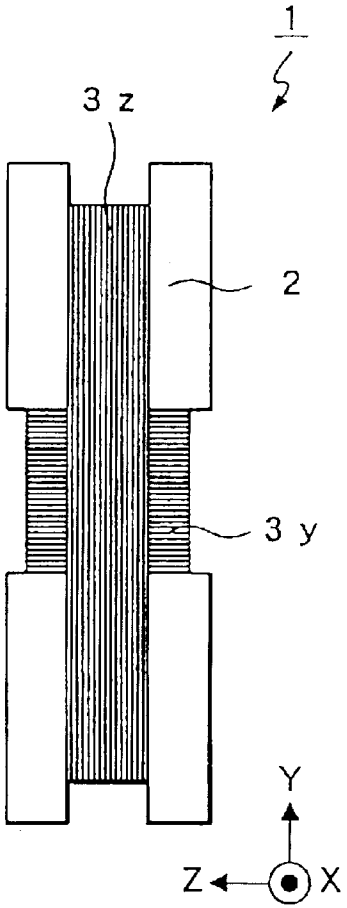
FIG. 1B is a side view showing structure of the reception antenna.
Figure 1A:
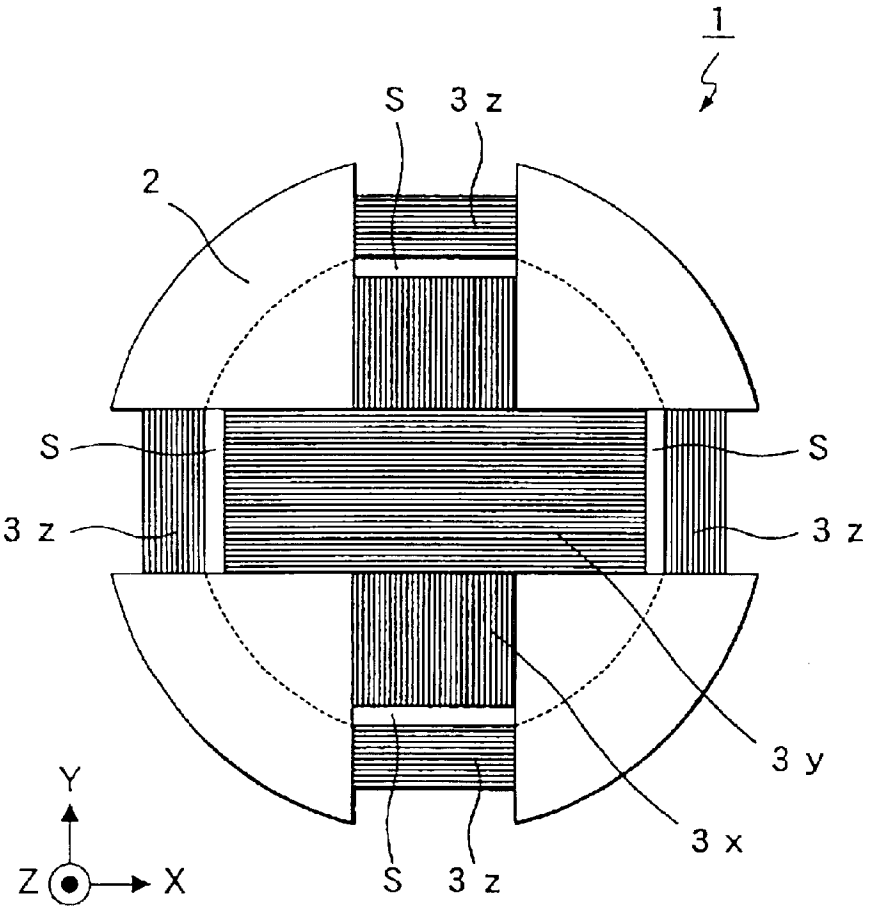
FIG. 1A is a top view showing structure of a reception antenna.

An embodiment of the present invention will be explained with figures. FIGS. 1A and 1B are a top and a side views showing structure of a three-axis integrated reception antenna (hereinafter referred to only "reception antenna").

A reception antenna 1 of the embodiment is formed of a column-profiled ferrite core 2 and three antenna coils 3*x*, 3*y* 3*z*, each of which is formed by winding electric wire around the core 2. Each central axis of the three antenna coils 3*x*, 3*y*, 3*z* is mutually disposed orthogonally at a barycenter of the core 2, and each of the three antenna coils 3*x*, 3*y*, 3*z* is symmetrical with respect to the barycenter.

Here, a direction of the central axis of the core 2 is z direction. Two directions being orthogonal with each other in a sectional plane that is orthogonal to the central axis of the core 2 are X and Y directions. The antenna coil 3*x* is formed by winding electric wire around the core 2 with being centering on X direction. The antenna coil 3*y* is formed by winding electric wire around the core 2 with being centering on Y direction. The antenna coil 3*z* is formed by winding electric wire around the circumference of the core 2 with being centering on Z direction.

Figure 2B:
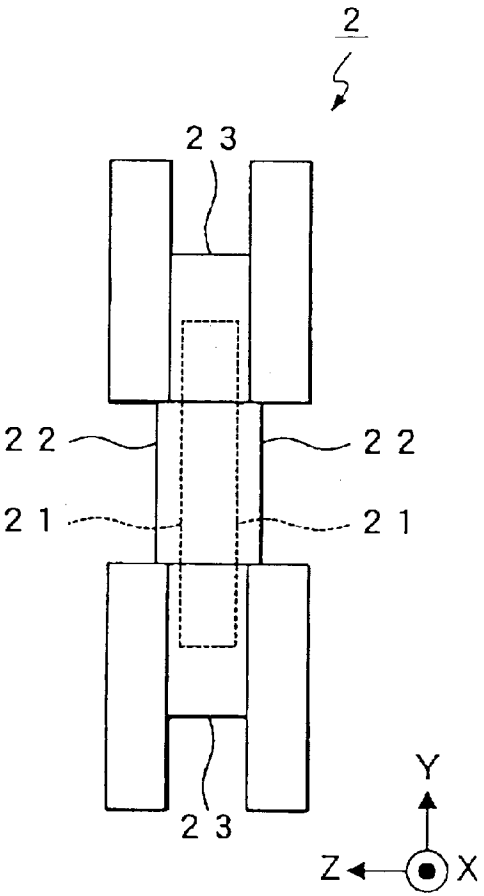
FIG. 2B is a side view showing structure of the core.
Figure 2A:
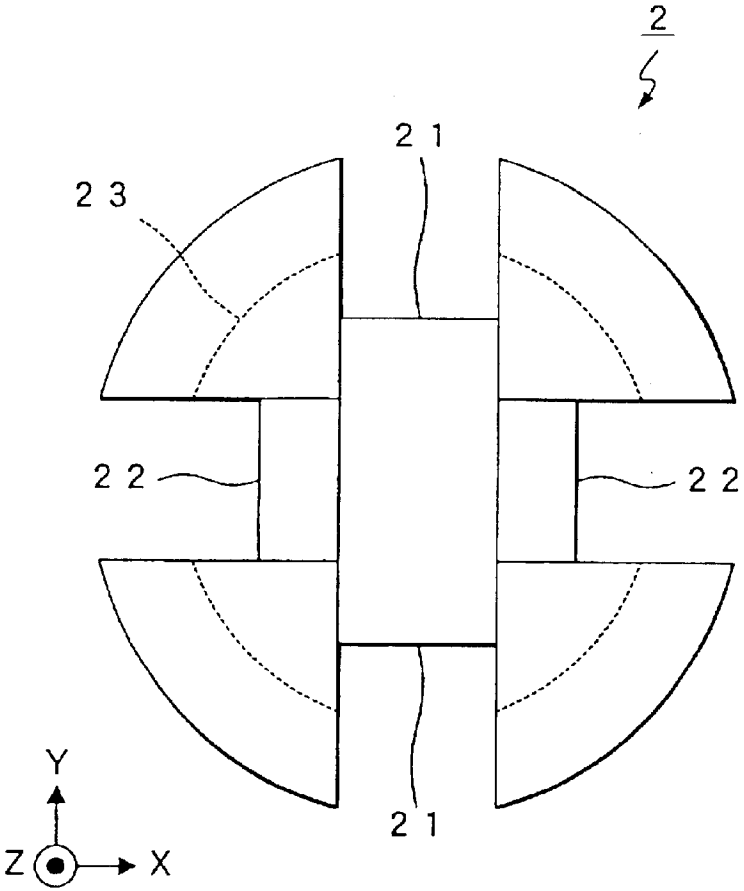
FIG. 2A is a top view showing structure of a core.

Here, FIGS. 2A and 2B show a top and side views of the core 2 whose antenna coils 3*x*, 3*y*, 3*z* are removed. A first groove 21 is formed into being orbiting around (or in parallel with) Y-Z sectional plane including the central axis and the barycenter of the core 2. A second groove 22 is, formed into being orbiting around (or in parallel with) X-Z sectional plane including the central axis and the barycenter of the core 2. A third groove 23 is formed into being orbiting around (or in parallel with) X-Y sectional plane including the barycenter of the core 2.

The first groove 21 has a greater depth, from two base surfaces sandwiching a curved surface of the core 2, than the second groove 22. Each of the first and second grooves 21, 22 has a greater depth, from the curved surface of the core 2, than the third groove 23.

In the above constructed core 2, the antenna coil 3*x* is firstly formed by winding electric wire along the first groove 21. The antenna coil 3*y* is secondly formed by winding electric wire along the second groove 22. The antenna coil 3*z* is finally formed by winding electric wire along the third groove 23. The reception antenna 1 is thereby formed.

Here, each electric wire is wound to cover a base of the groove to make the first layer. The second layer is formed into being covering the first layer, and similarly the electric wire is outwardly and regularly wound. In each of the antenna coils 3*x*, 3*y*, 3*z*, a starting end of the wound electric wire is inwardly located (towards the base of the groove), while a terminating end of the wound electric wire is, outwardly located (towards the opening of the groove).

The antenna coil 3*x* formed using the first groove 21 and the antenna coil 3*y* formed using the second groove 22 form an overlapping area. In the overlapping area, a layer of the electric wire adjacent to the terminating end of the antenna coil 3*x* and a layer of the electric wire adjacent to the starting end of the antenna coil 3*y* make contact with each other. The antenna coil 3*z* formed using the third groove 23 and the respective antenna coils 3*x*, 3*y* also form other two overlapping areas. In the overlapping areas, each of layers of the electric wire adjacent to the terminating ends of the antenna coils 3*x*, 3*y* and a layer of the electric wire adjacent to the starting end of the antenna coil 3*z* has a space S (0.7 to 1.0 mm) between them.

Figure 3:
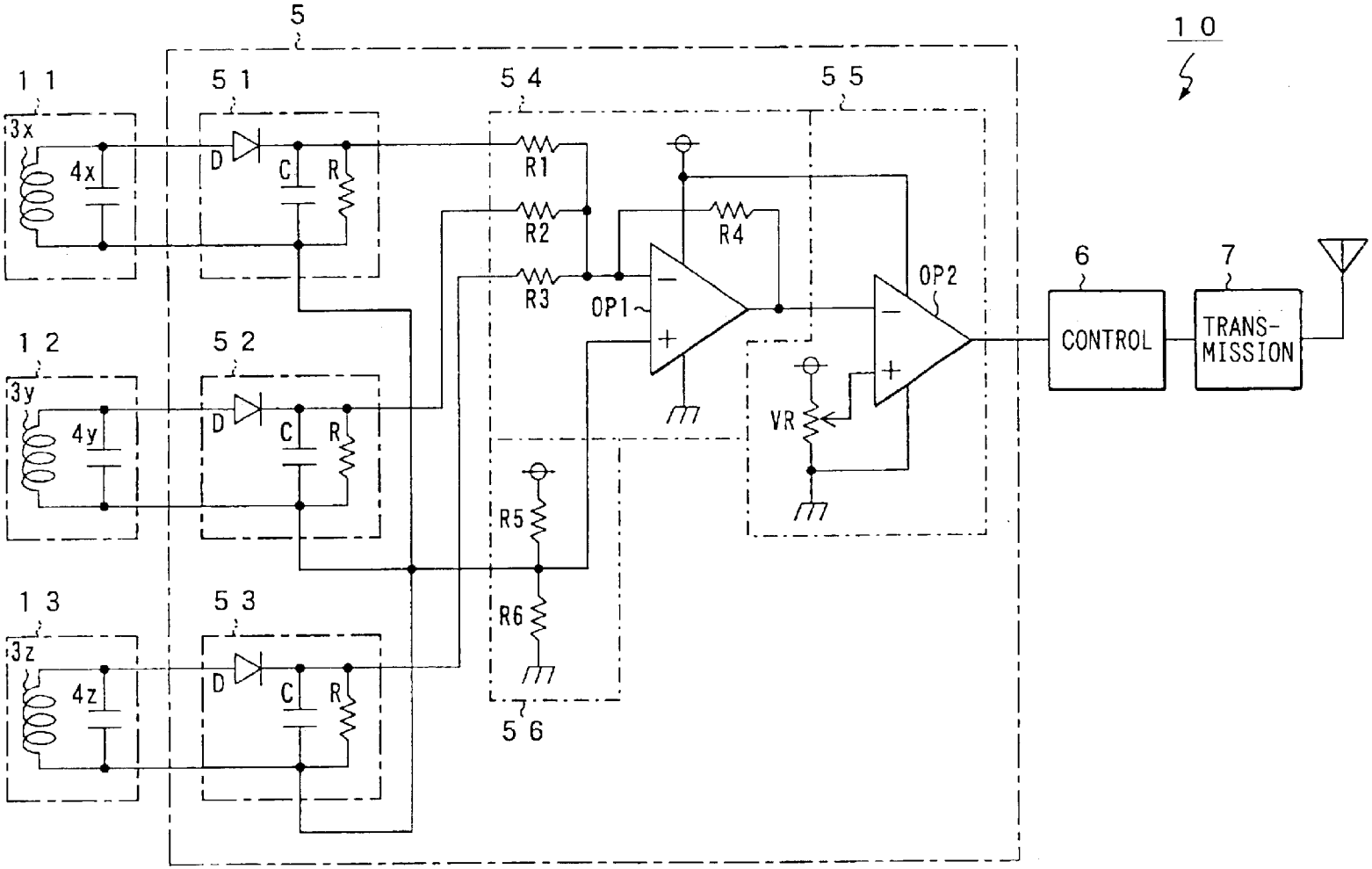
FIG. 3 is a diagram showing an electrical structure of a portable device.

Next, FIG. 3 shows an internal structure of a portable device 10 (here, an electronic key). The portable device 10 is used in an electronic key system that controls locking/unlocking of a vehicle door through communicating by wireless between an in-vehicle device mounted in a vehicle and an electronic key.

As shown in FIG. 3, the portable device 10 includes the following: an X-axis antenna 11; a Y-axis antenna 12; a Z-axis antenna 13; a reception circuit 5; a control micro-computer 6; and a transmission circuit 7. The X-axis antenna 11 includes the antenna coil 3*x* constituting the reception antenna 1, and a capacitor 4*x* constituting a resonance circuit. The Y-axis antenna 12 includes the antenna coil 3*y* constituting the reception antenna 1, and a capacitor 4*y* constituting a resonance circuit. The Z-axis antenna 13 includes the antenna coil 3*z* constituting the reception antenna 1, and a capacitor 4*z* constituting a resonance circuit. The reception circuit 5 receives signals, modulated with ASK (amplitude shift keying) through the antennas 11, 12, 13, to demodulate into a digital signal. The control micro-computer 6 executes various controls based on the digital signal into which the reception circuit 5 demodulates. The transmission circuit 7 transmits to the in-vehicle device by wireless.

The antennas 11, 12, 13 have a common terminal and respective individual terminals. The terminating end of the antenna coil 3$x$, the starting end of the antenna coil 3$y$, and either of the starting or terminating end of the antenna coil 3$z$ are connected to the common terminal.

The reception circuit 5 includes wave detection circuits 51 to 53 provided in each antenna 11 to 13, an addition circuit 54, a waveform adjustment circuit 55, and a voltage division circuit 56. The addition circuit 54 adds output from each of the wave detection circuits 51 to 53. The waveform adjustment circuit 55 generates a digital signal by digitizing output from the addition circuit 54. The voltage division circuit 56 generates reference voltage, which is applied into the respective individual terminals, by dividing power voltage with resistors R5, R6.

Each of the wave detection circuits 51 to 53 similarly has a known circuit including a diode D, a capacitor C, and a resistor R and executes envelope curve detection for each reception signal from the corresponding antenna 11 to 13.

The addition circuit 54 adds relative values of outputs from the respective wave detection circuits 51 to 53, the relative values that are relative to an output from the common terminal of the antennas 11 to 13 (reference voltage generated by the voltage division circuit 56). The addition circuit 54 has a known circuit that includes an operational amplifier OP1 and resistors R1 to R4.

The waveform adjustment circuit 55 formed of an operational amplifier OP2 used as a comparator adjusts a threshold voltage with a variable resistor VR in digitizing the output from the addition circuit 54. In FIG. 4, signal states in various sections in the reception circuit 5 are shown. Here, a magnetic field is generated in pulse from a direction that has a predetermined angle θ (<±45 degrees) to X-axis and is orthogonal to Z-axis (refer to FIG. 4A).

Figure 4A:
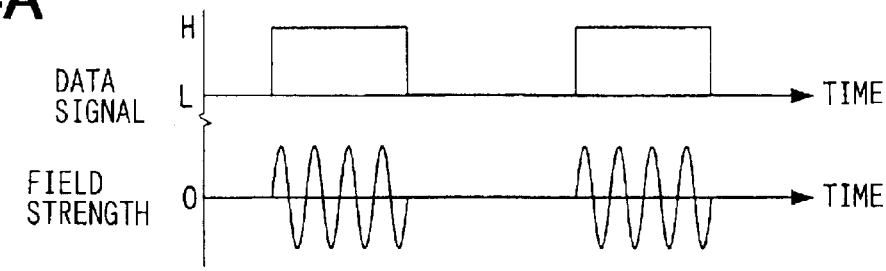
FIGS. 4A to 4E are wave form charts showing wave forms of respective sections of the portable device.
Figure 4B:
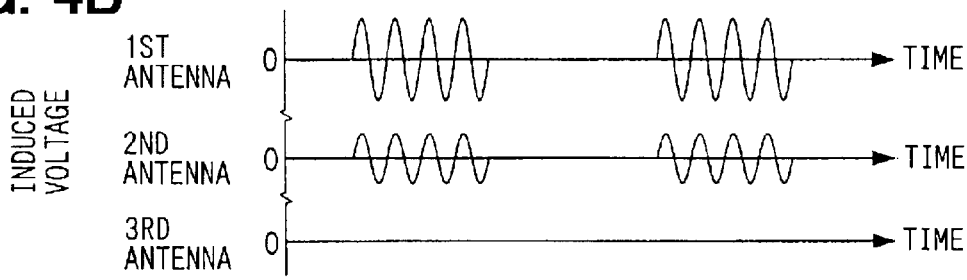

As shown in FIG. 4B, induced voltages are generated in phase or in opposite phase to magnetic field change in the antenna coils 3$x$, 3$y$, 3$z$ according to a magnetic field direction and a winding direction. Here, since the direction of the central axis of the antenna coil 3$z$ is orthogonal to the magnetic field direction, the antenna coil 3$z$ has no intersecting magnetic flux. No induced voltage is thereby generated in the antenna coil 3$z$. Since the direction of the central axis of the antenna coil 3$x$ has a smaller angle to the magnetic field direction than that of the antenna coil 3$y$, greater induced voltage is thereby generated in the antenna coil 3$x$ than in the antenna coil 3$y$.

Figure 4C:
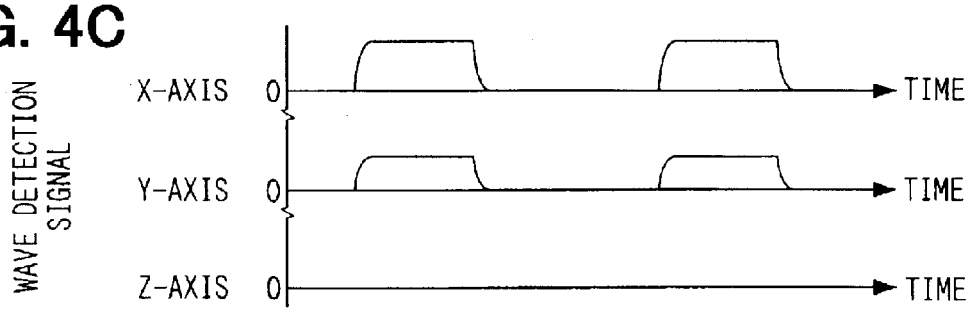
Figure 4D:
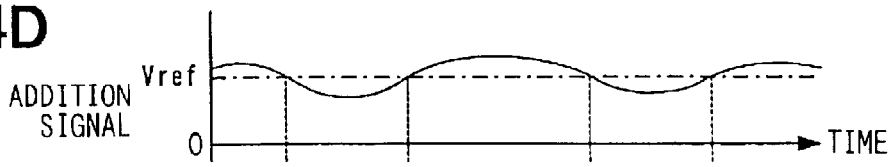
Figure 4E:
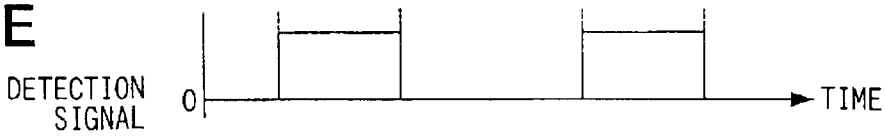

For the induced voltages in the antennas 3$x$, 3$y$, 3$z$, the wave detection circuits 51 to 53 execute envelope curve detection. As shown in FIG. 4C, detection signals are obtained according to amplitudes of the induced voltages. The addition circuit 54 generates an addition signal shown in FIG. 4D and the waveform adjustment circuit 55 then generates a detection signal of digital waveform as shown in FIG. 4E by digitizing the addition signal at a threshold voltage Vref.

As explained above, in this embodiment, the X-axis, Y-axis, and Z-axis antennas 11 to 13 are formed of the three antenna coils 3$x$, 3$y$, 3$z$, whose central axis is orthogonal to each other. The outputs from the three antennas 11 to 13 are demodulated to be added for obtaining the addition signal. The addition signal is then used for obtaining the detection signal of the digital waveform.

Figure 7B:
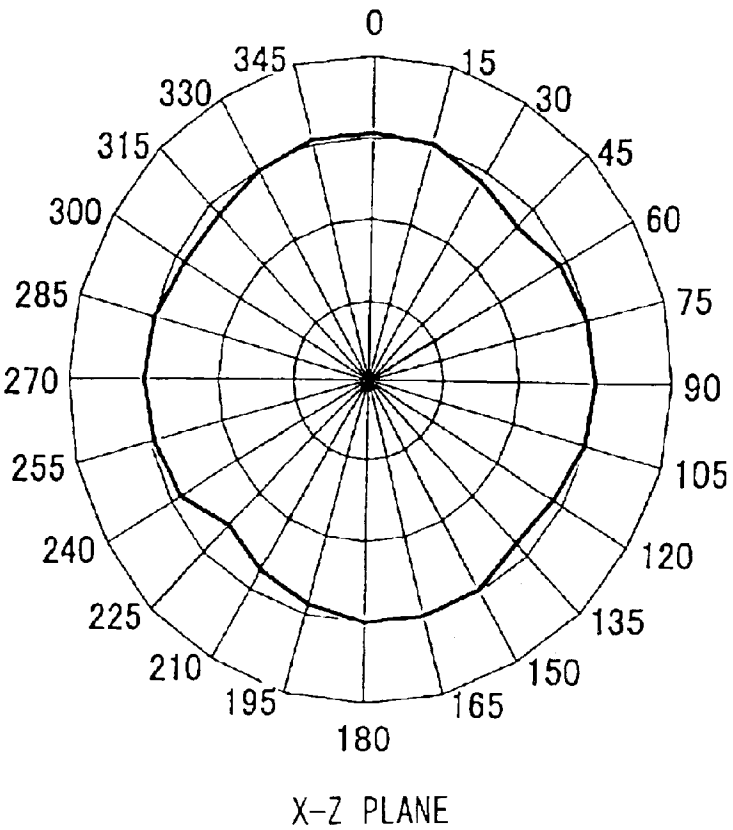
FIGS. 7A to 7B are diagrams showing measurement results of directionality of a reception antenna.
Figure 7A:
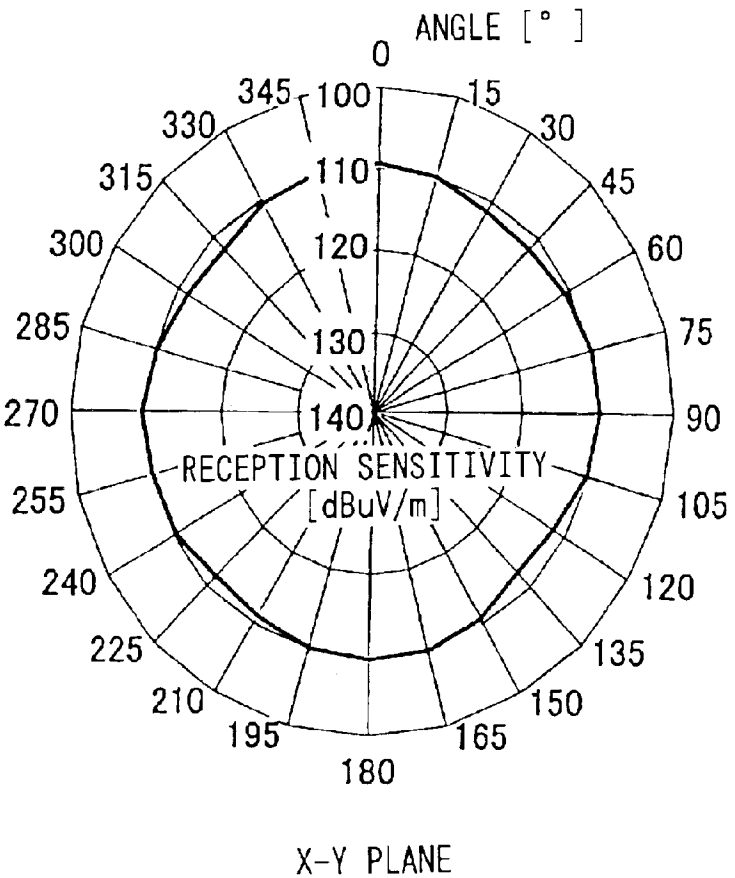
Figure 8A:
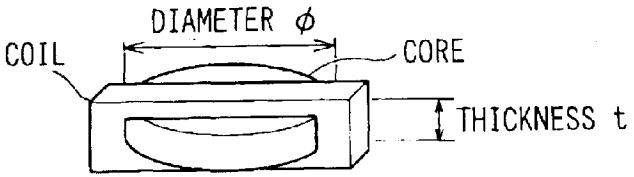
FIG. 8A is a view showing dimensions of an antenna.
Figure 8B:
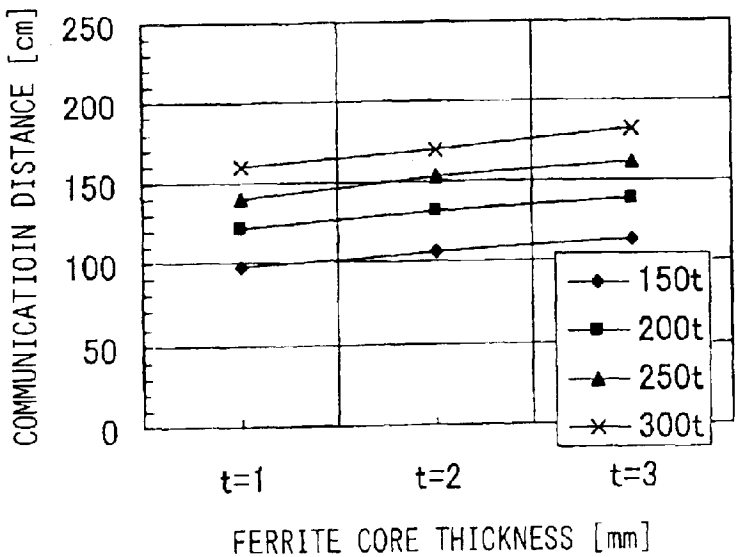
FIGS. 8B to 8C are diagrams showing relationship among a communication distance, a core thickness, a core diameter, and a number of turns of an antenna coil of X-axis and Y-axis antennas.
Figure 8C:
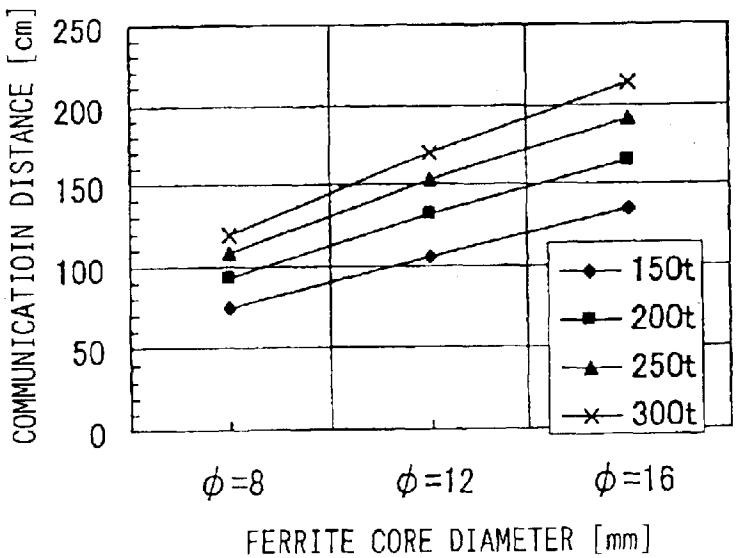
Figure 9A:
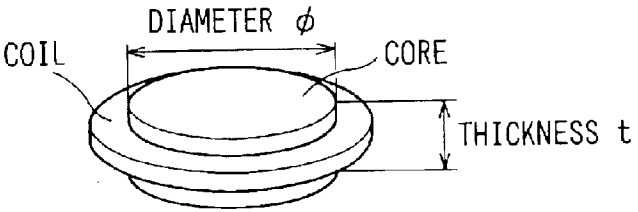
FIG. 9A is a view showing dimensions of an antenna.
Figure 9B:
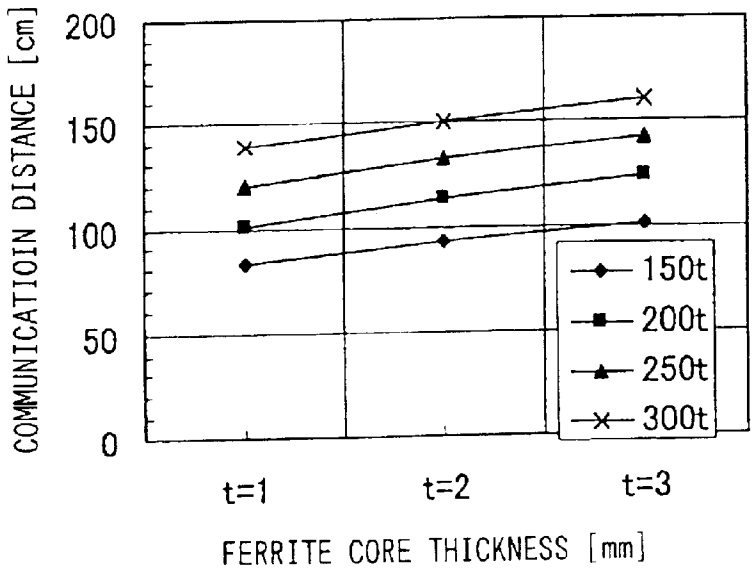
FIGS. 9B to 9C are diagrams showing relationship among a communication distance, a core thickness, a core diameter, and a number of turns of an antenna coil of a Z-axis antenna.
Figure 9C:
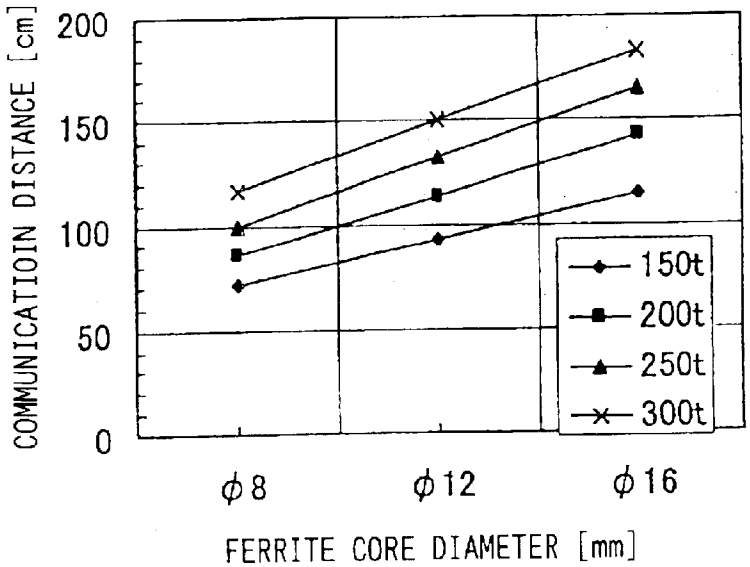

Thus even if the magnetic field approaches from any direction, at least one of the three antennas 11 to 13 generates output and, in addition, almost constant reception sensitivity can be realized as shown in. FIGS. 7A and 7B. Here, the reception sensitivity results are shown based on the output of the addition circuit 54. The output of the addition circuit 54 is obtained when the approaching direction of the magnetic field is varied in the range of 360 degrees on each of X-Y plane and X-Z plane.

In this embodiment, in the reception antenna 1, the three antenna coils 3$x$, 3$y$, 3$z$ are mutually overlapped by winding electric wire around a single core 2. A necessary volume is thereby drastically minimized. This results in downsizing the portable device including the reception antenna 1.

The antenna coils that are formed as the above are mutually overlapped, so that stray capacitance is generated at an overlapping area. When the antenna coils are mutually connected due to the stray capacitance, impedance is changed and distortion is generated in an amplitude characteristic or a phase characteristic to result in lowering a characteristic of the reception antenna.

When an antenna coil is formed by winding electric wire around the core 2, the electric wire is wound from an inward to an outward. A terminating end of winding electric wire of an inwardly-located antenna coil is thereby very close to a starting end of winding electric wire of an outwardly-located antenna coil, so that the stray capacitance is comparatively strongly generated between the two antenna coils.

Therefore, in the reception antenna 1, the antenna coils 3$x$, 3$y$, whose winding electric wire are overlapped in contact, have the common terminal where the terminating end of the antenna coil 3$x$ and the starting end of the antenna coil 3$y$ are connected.

This leads to short-circuiting both ends of overlapping area and results in lowering influence of the stray capacitance. The third antenna coil 3$z$ needs to be connected with the common terminal through either end of its own. However, even if the either end is connected with the common terminal, the influence of the stray capacitance with the either of the first and second antenna coils cannot be lowered.

Therefore the antenna coil 3$z$ and each of the antenna coils 3$x$, 3$y$ are overlapped with the space S (clearance) since the space S provided between the overlapped antenna coils decreases the stray capacitance. Providing the space S between the third antenna coil and each of the first and second antenna coils results in additionally enhancing prevention of the influence of the stray capacitance in the reception antenna 1.

Figure 5:
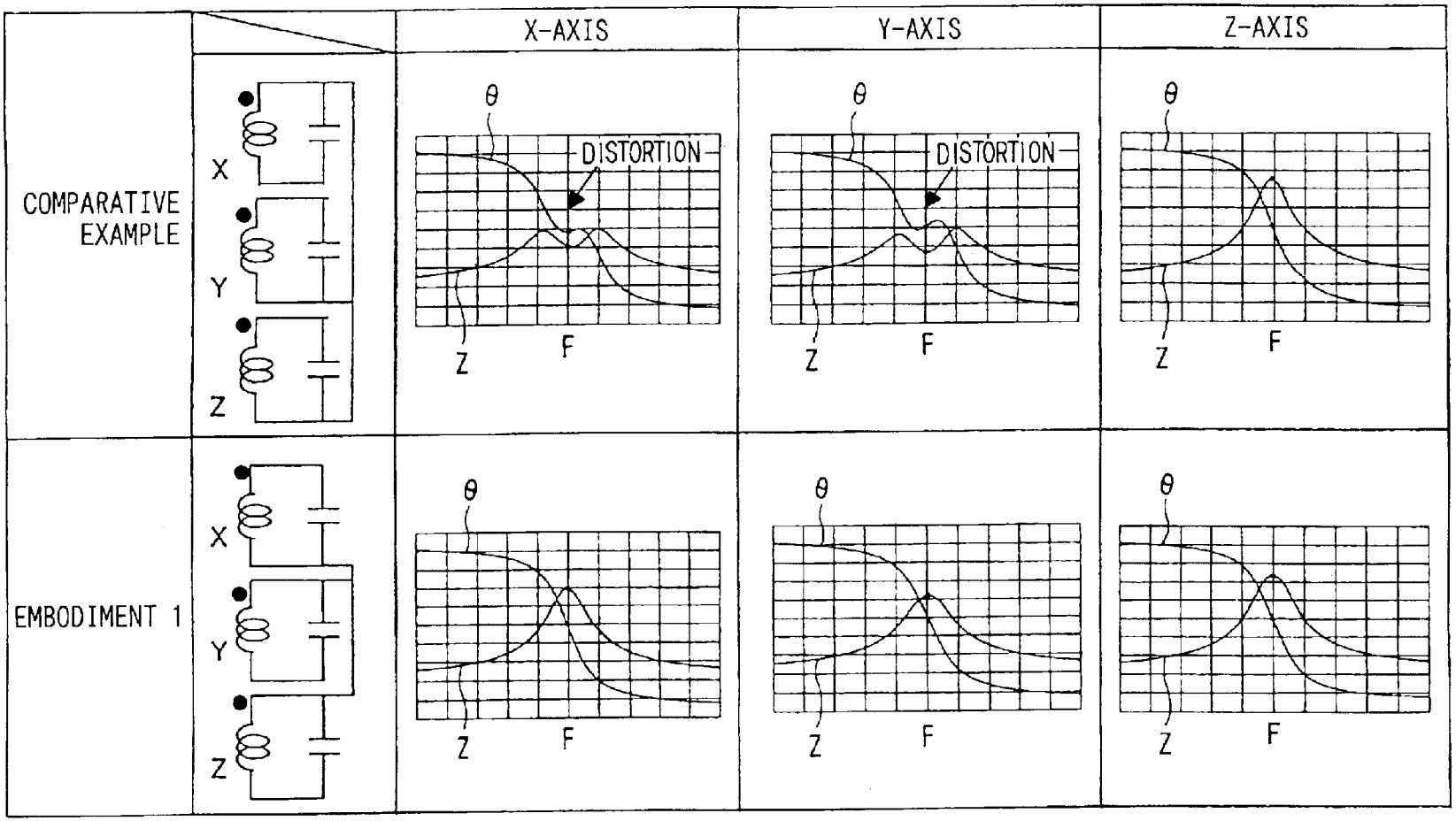
FIG. 5 is diagrams showing measurement results of X-axis, Y-axis, and Z-axis antenna characteristics.
Figure 6:
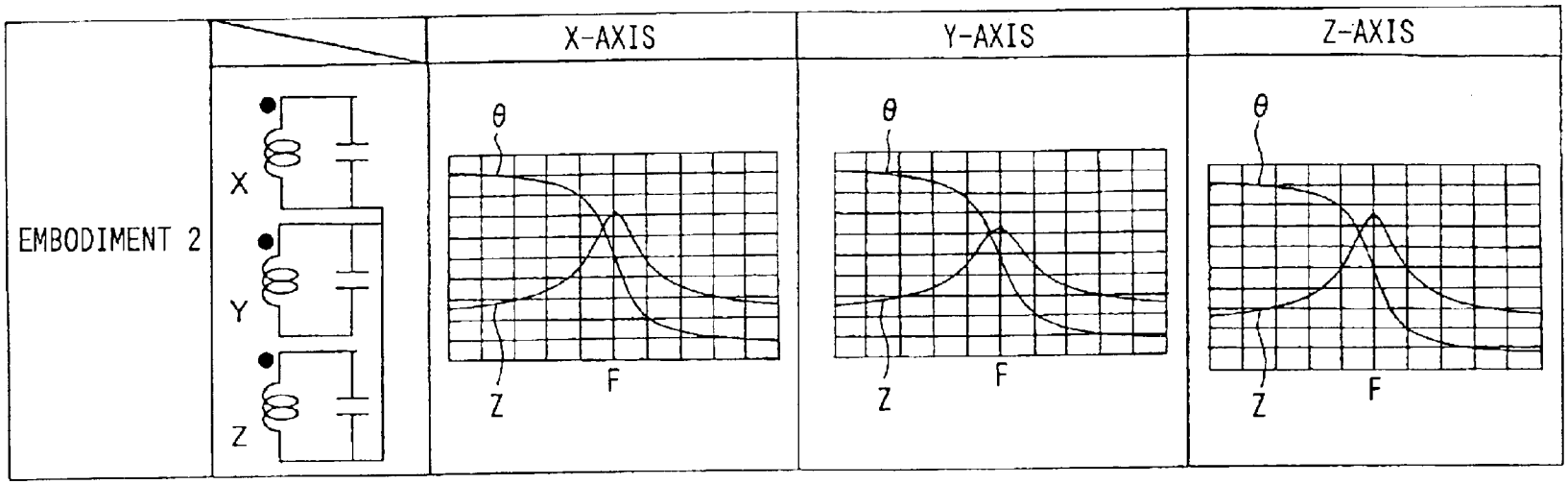
FIG. 6 is diagrams showing measurement results of X-axis, Y-axis, and Z-axis antenna characteristics.

In FIGS. 5 and 6, measuring results of antenna characteristics (impedance Z (−100 to 400 kΩ) and phase θ (−100 to 100 degrees) in a longitudinal axis, radio frequency F (120 to 150 kHz) in a lateral axis) of each axis are shown regarding a comparative example, a first embodiment, and a second embodiment. Here, each starting end of the antenna coils 3$x$, 3$y$, 3$z$ is shown as a black point (•) in each of schematic circuit diagrams included in FIGS. 5 and 6. The comparative example is a case where the starting end of the antenna coil 3$x$ and the terminating end of the antenna coil 3$y$ are connected in the common terminal. The first and second embodiments are cases where the terminating end of the antenna coil 3$x$ and the starting end of the antenna coil 3$y$ are connected in the common terminal. In the first embodiment, the starting end of the antenna coil 3$z$ is connected to the common terminal, while the terminating end of the antenna coil 3$z$ is connected to the common terminal in the second embodiment.

The measuring results exhibit that the comparative example produces distortion (at F=134 kHz) in the antenna characteristic due to connection among the antenna coils from stray capacitance. By contrast, the first and second embodiments produce no distortion in the antenna characteristic. According to the embodiments of the present invention, influence from the stray capacitance is thus prevented, so that a favorable antenna characteristic can be obtained.

In FIGS. 8A to 8C and 9A to 9C, measuring results of communication distance of an antenna are shown with varying an antenna coil in thickness t (1, 2, 3 [mm]), diameter ϕ (8, 12, 16 [mm]), number of turns (150, 200, 250, 300 [turn]) of the core 2.

Measurement is executed at radio wave transmission output in accordance with Japanese radio law. The X-axis and Y-axis antennas 11, 12 receive the transmission output in FIGS. 8A to 8C, while the Z-axis antenna 13 receives the transmission output in FIGS. 9A to 9C. In detail, a portable device is constructed as shown in FIG. 3. A reception circuit 5 is constructed so that a digital signal can be outputted by digitizing the input signal when an input signal of 5 mVp-p in an individual terminal of the antenna. Respective antennas are connected with the reception circuit 5 and resonance capacitors 4 also are connected with the reception circuit 5 with producing parallel resonance with transmission frequency. Communication distance is hence measured under a condition where the reception circuit 5 accurately demodulates the transmitted data.

Measuring results exhibit that, in any one of the antennas 11 to 13, increasing of a diameter ϕ of the core 2 is more contributory for increasing the communication distance than increasing of a thickness t of the core 2, and increasing of a number of turns of the antenna coils is also effective. To obtain the communication distance of a range from 100 to 150 cm under the Japanese radio law, it is required that the diameter is 10 to 14 mm and the number of the turns is 200 to 300 turns.

By contrast, since the thickness of the core 2 is not influential to the communication distance, so that the reception antenna 1 can be thinner with hardly lowering the communication distance.

The embodiment of the present invention is explained in the above. However, the present invention is not limited to the above embodiment but also directed to any other embodiments as long as the content of the present invention is applied to.

Figure 10:
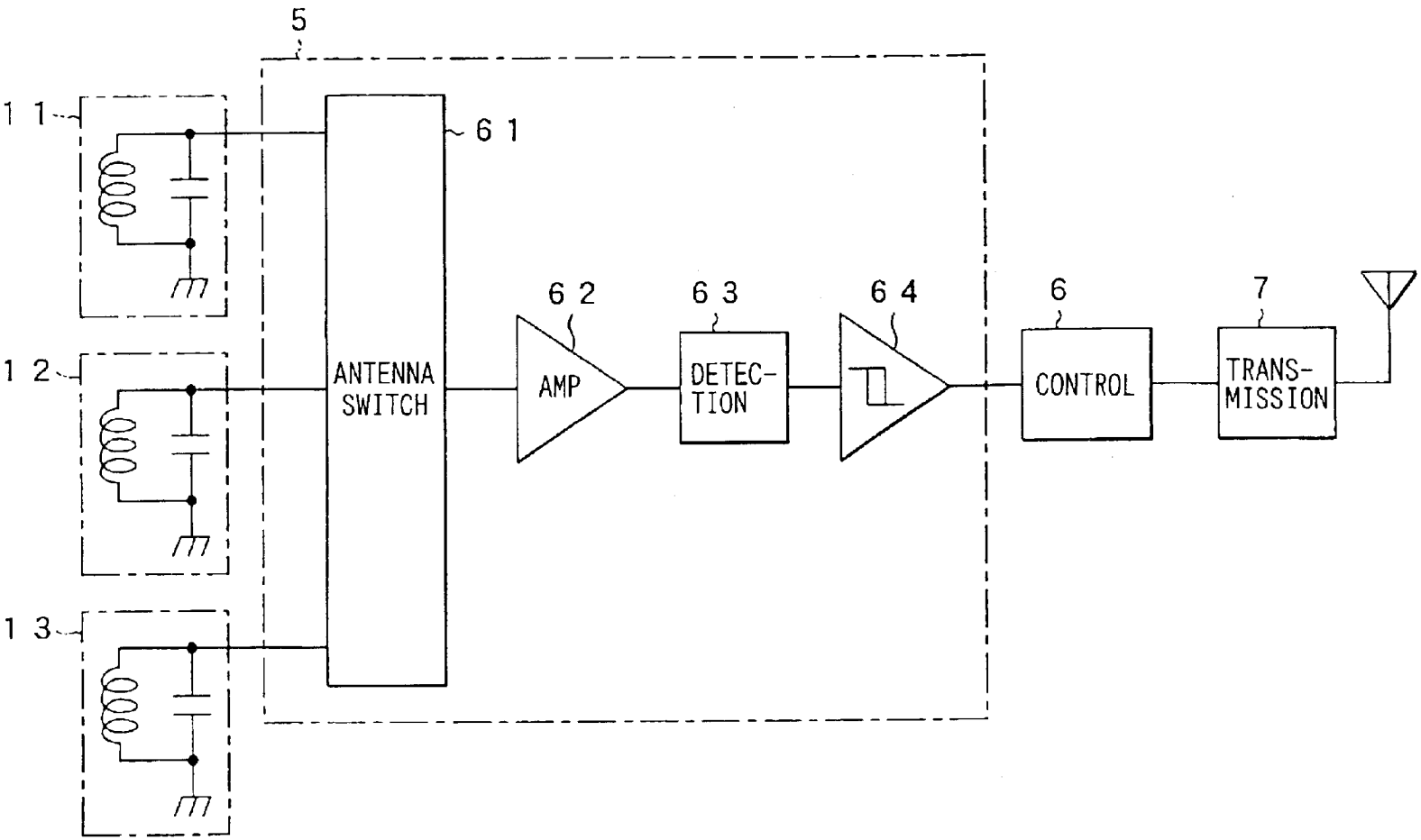
FIG. 10 is a diagram showing another electrical structure of a portable device.

For instance, in the above embodiment, in the reception circuit 5, outputs from the three antennas are demodulated to be added for obtaining the addition signal. The addition signal is then used for obtaining the detection signal of the digital waveform. However, as shown in FIG. 10, an antenna switch circuit 61 is provided for selecting the maximum output among the outputs from the three antennas. The selected maximum output is then amplified in an amplifier 62 to be demodulated in a wave detection circuit 63. The demodulated output from the wave detection circuit 63 is thereby digitized in a waveform adjustment circuit 64. Here, only one wave detection circuit 63 is provided in the reception circuit 5, so that device structure is simplified.

Figure 11B:
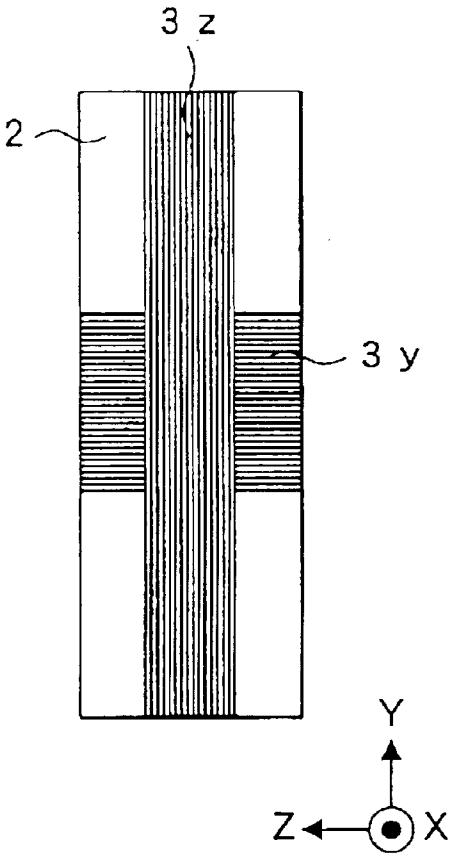
FIG. 11B is a side view showing structure of another reception antenna.
Figure 11A:
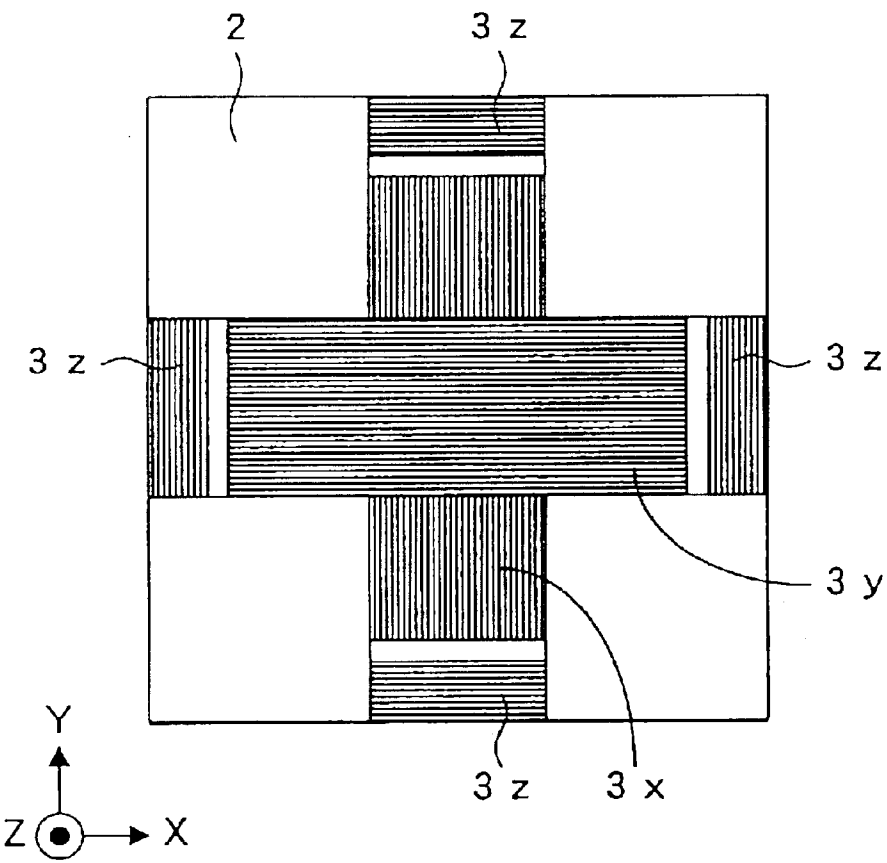
FIG. 11A is a top view showing structure of another reception antenna.

In the above embodiment, although a column-profiled core 2 is used, a core 2 can be a regular tetragonal prism as shown in FIGS. 11A and 11B. A core 2 can be also a polygonal prism or an elliptic prism.

Figure 12B:
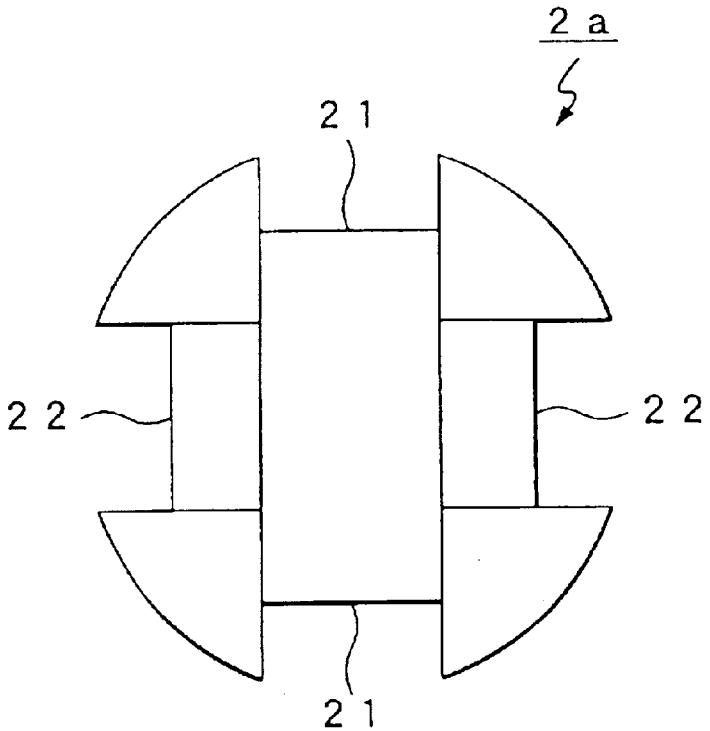
FIG. 12B is a top view showing structure of a second portion of another core.
Figure 12A:
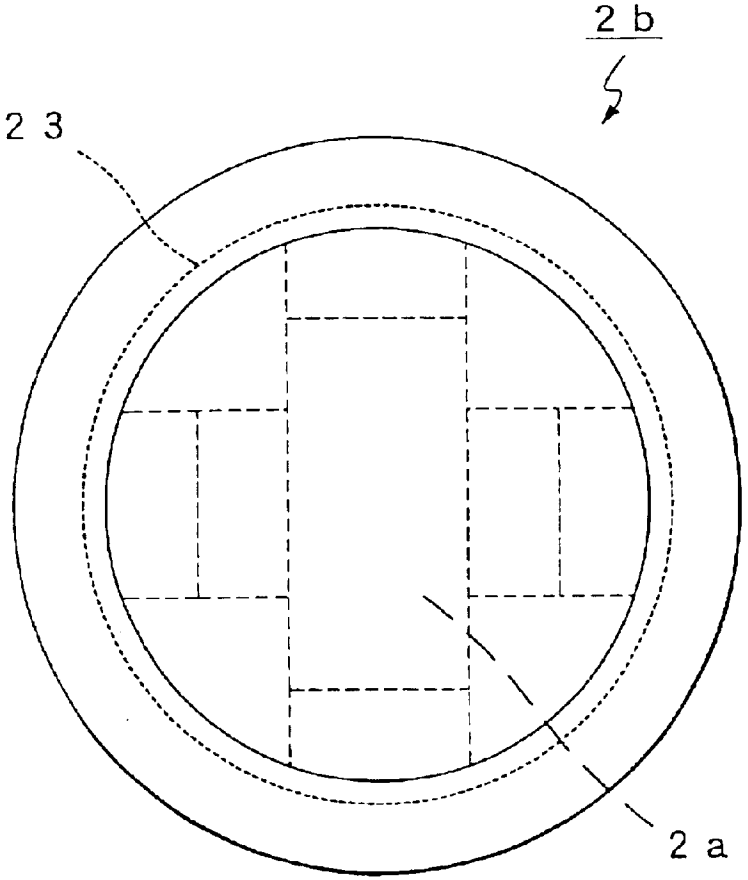
FIG. 12A is a top view showing structure of a first portion of another core.

In the above embodiment, the first to third grooves for winding electric wire are provided in a single core. However, a first and second grooves are provided in a first division portion 2*a* as shown in FIG. 12B. A third groove is provided, as shown in FIG. 12A, in a second division portion 2*b* into which the first division portion is fitly inserted.

In this case, the first division portion 2*a* and the second division portion 2*b* are assembled after the electric wire is wound on both portions, so that operation of manufacturing the reception coil is enabled to be efficiently completed.

Furthermore, although a core 2 is formed of ferrite, a core can be formed of synthetic resin.

What is claimed is:

1. A core around which electric wire is wound to form each of three antenna coils, the core that has a shape of at least one of a cylinder and a prism whose section is symmetrical to a point where e a center axis of the core passes through, the core comprising:

a first groove member that is formed on a surface of the core and orbits along a perimeter of a first virtual sectional plane, which includes the center axis of the core;

a second groove member that is formed on the surface of the core and orbits along a perimeter of a second virtual sectional plane, which includes the center axis of the core, wherein the second virtual sectional plane is orthogonal to the first virtual sectional plane; and a third groove member that is formed on the surface of the core and orbits along a perimeter of a third virtual sectional plan that is orthogonal to the central axis, the perimeter of the third virtual sectional plane is on a curved surface that is disposed between base surfaces of the core, the base surfaces which are symmetrical to the point where the center axis passes through.

2. A core according to claim 1, wherein the core includes a first portion and a second portion, wherein the first portion includes the first and second groove members and the second portion includes the third groove member, and wherein the first portion is fitly inserted into the second portion.

3. A portable device comprising:

a reception antenna that includes, three antenna coils whose center axes mutually orthogonally intersect at an intersecting point and each of which is symmetrical to the intersecting point; and a core around which electric wire is wound to form each of the three antenna coils, wherein a first antenna coil of the three antenna coils is most inwardly formed and a third antenna coil is most outwardly formed, wherein a second antenna coil is formed between the first antenna oil and the third antenna coil, wherein the second antenna coil and one of the first antenna coil and the third antenna coil constitutes a pair of selected antenna coils, and wherein a terminating end of winding electric wire of an inwardly-located antenna coil of the pair of the selected antenna coils is connected with a starting end of winding electric wire of an outwardly-located antenna coil of the pair of the selected antenna coils;

a reception circuit that receives, through the three antenna coils, a signal to demodulate into a digital signal; and a control circuit that executes a control based on the digital signal demodulated in the reception circuit.

4. A portable device according to claim 3, wherein the other antenna coil that is excluded from the pair of the selected antenna coils and each of the pair of the selected antenna coils are overlapped with a space.

5. A portable device according to claim 3, wherein the reception circuit includes:

three wave detection circuits, each of which is provided in each of the three antenna coils and detects an output from each of the three antenna coils;

an addition circuit that adds outputs from the three wave detection circuits; and a waveform adjustment circuit that digitizes an output from the addition circuit.

6. A portable device according to claim 3, wherein the reception circuit includes:

signal selecting means for selecting a maximum signal whose amplitude is maximum among the signals from the three antenna coils;

an amplifier that amplifies the selected maximum signal;

a way detection circuit that detects an output from the amplifier; and a way form adjustment circuit that digitizes an output from the wave detection circuit.

* * * * *